US009869043B2

(12) United States Patent
Spengler et al.

(10) Patent No.: US 9,869,043 B2
(45) Date of Patent: Jan. 16, 2018

(54) QUILTING DEVICE

(71) Applicant: BERNINA International AG, Steckborn (CH)

(72) Inventors: Stephan Spengler, Siblingen (CH); Severin Brunner, Steckborn (CH); Roland Beer, Weinfelden (CH); Gunnar Schlaich, Constance (DE); Ioannis Imionidis, Steckborn (CH)

(73) Assignee: BERNINA International AG, Steckborn (CH)

( * ) Notice: Subject to any disclaimer, the term of this patent is extended or adjusted under 35 U.S.C. 154(b) by 0 days.

(21) Appl. No.: 15/190,753

(22) Filed: Jun. 23, 2016

(65) Prior Publication Data

US 2016/0376739 A1 Dec. 29, 2016

(30) Foreign Application Priority Data

Jun. 29, 2015 (CH) ..... 0933/15

(51) Int. Cl.
*D05B 69/00* (2006.01)
*D05B 11/00* (2006.01)
*D05B 21/00* (2006.01)

(52) U.S. Cl.
CPC ..... *D05B 11/00* (2013.01); *D05B 21/00* (2013.01); *D05B 69/00* (2013.01); *D05D 2205/02* (2013.01)

(58) Field of Classification Search
CPC ..... D05B 11/00; D05B 21/00; D05B 39/005
USPC ..... 112/117–119
See application file for complete search history.

(56) References Cited

U.S. PATENT DOCUMENTS

| | | | | |
|---|---|---|---|---|
| 4,192,241 | A * | 3/1980 | Reed | D05B 11/00 112/117 |
| 6,631,688 | B1 * | 10/2003 | Maag | D05B 11/00 112/118 |
| 6,792,884 | B1 * | 9/2004 | Barrus | D05B 11/00 112/119 |
| 6,883,446 | B2 * | 4/2005 | Koerner | D05B 19/14 112/272 |
| 6,932,008 | B2 * | 8/2005 | Pfeifer | D05B 39/005 112/117 |
| 6,951,178 | B2 * | 10/2005 | Watts | D05B 11/00 112/118 |
| 6,990,914 | B2 * | 1/2006 | Canan | D05B 11/00 112/119 |
| 7,011,031 | B1 * | 3/2006 | Bradley | D05B 11/00 112/119 |
| 7,207,281 | B1 | 4/2007 | Kasa | |
| 9,109,313 | B2 * | 8/2015 | Bagley | D05B 11/00 |
| 9,487,896 | B2 * | 11/2016 | Schwarzberger | D05B 11/00 |
| 2009/0272304 | A1 * | 11/2009 | Watts | D05B 11/00 112/118 |

(Continued)

*Primary Examiner* — Danny Worrell
(74) *Attorney, Agent, or Firm* — Volpe and Koenig, P.C.

(57) ABSTRACT

A quilting device (1) comprises a processing unit (5) which is mounted on a frame (3) so as to be manually displaceable in two movement directions (M1, M2) by an operator. A detection device (29) having sensors (27) detects the guiding force which is exerted in these movement directions (M1, M2) by the operator. A controller device (35) controls or regulates, respectively, auxiliary motors (33*a*, 33*b*) which support the guiding force, so as to depend on the detected guiding force.

9 Claims, 1 Drawing Sheet

(56) References Cited

U.S. PATENT DOCUMENTS

2011/0203506 A1* 8/2011 Price ..... D05C 15/26
112/475.08

* cited by examiner

QUILTING DEVICE

INCORPORATION BY REFERENCE

The following documents are incorporated herein by reference as if fully set forth: Swiss Patent Application No. 0933/15, filed 29 Jun. 2015.

BACKGROUND

The subject matter of the invention is a quilting device, and a method for moving the processing unit of a quilting device.

Quilting devices which are suitable for producing large quilts have a long quilting table or quilting frame (hereunder referred to as the "frame" in short) on which a processing unit is mounted so as to be movable in two directions of a guiding plane. The processing unit usually comprises a first carriage or slide, respectively, which is mounted so as to be traversable along a longitudinal guide, and a second carriage or slide, respectively, which is mounted so as to be traversable in a manner orthogonal to the longitudinal guide on the first slide. A long-arm sewing machine which is fixedly connected to the second slide in the case of such quilting devices may be traversed in two movement directions of a guiding plane which are predefined by the guides of the two slides. The freedom of movement of the processing unit in the guide plane is restricted in both movement directions. A utilizable range within which a two-dimensional textile structure may be processed by the stitch-forming tools of the sewing machine is formed as a result. The two-dimensional structure to be processed may comprise one or a plurality of layers which may each be rewound from a supply roll to a take-up roll. Processing of the two-dimensional structure is performed in portions, that portion of the two-dimensional structure that is located in the utilizable range being in each case held tensioned so as to lie on the needle plate of the sewing machine, and so as to be parallel with the guide plane.

The processing unit typically comprises one or a plurality of handles. During quilting or stitching, respectively, one operator holds the processing unit by the handle or by the handles, respectively, guiding or moving, respectively, said handle or handles in relation to the two-dimensional structure according to the pattern to be established. By virtue of the comparatively large mass of the processing unit to be moved, the operator has to be apply correspondingly great forces when changing direction and/or speed. Additional resistance forces which have to be overcome may be caused for example by friction losses in the mounting, and/or by coupled drives which may optionally be used for moving the processing unit.

This may lead to fatigue, muscle tenseness and/or pain in the region of the shoulders and/or of the back of the operator already after a short time.

A drive assembly for a hand-guided quilting device which may be moved manually or alternatively automatically via drive motors is known from U.S. Pat. No. 7,207,281 B1. This quilting device comprises actuators by way of which the drive motors may optionally be coupled to the respective carriages for controlled or automatic operation, respectively, and may be decoupled therefrom for manual operation.

One disadvantage of this quilting device lies in that coupling devices having actuators are required in addition to the motors. One further disadvantage lies in that a comparatively large mass has to be moved in the manual operating mode. Since the drive motors are also disposed on the carriages, the former likewise have to be conjointly moved. Accordingly, the operator has to apply comparatively great forces for changing the movement direction and/or speed, this being ergonomically unfavorable, as is the case with other convention quilting devices.

SUMMARY

It is therefore an object of the present invention to provide a quilting device of which the processing unit may be manually moved at low effort in terms of force, and a method for moving this processing unit.

This object is achieved by a quilting device and by a method for moving the processing unit of a quilting device, including one or more features of invention.

The quilting device comprises a processing unit which is mounted on a frame so as to be manually traversable in two movement directions of a guide plane. At least for one, preferably for both movement directions, the guiding force which is exerted by an operator on the processing unit in the respective direction is detected by a detection device. In order for the movement or the drive, respectively, of the processing unit to be supported, one auxiliary motor is provided for this one movement direction, preferably for each of these two movement directions. Each of these auxiliary motors is controlled or regulated by a controller device so as to depend on the associated guiding force detected. Due to this, the guiding force which is to be applied by the operator for moving the processing unit may be reduced. The operator may move the processing unit in an effortless manner and using a minor effort of force in relation to the two-dimensional structure to be processed. Due to this, the risk of physical discomfort is minimized. The processing unit comprises a sewing machine, in particular a long-arm sewing machine, which is fixedly fitted on a platform of a traversing installation that is movable by one operator in two movement directions. In order for a two-dimensional structure to be processed, as an alternative to a sewing machine having stitch-forming tools, another installation having tools may also be disposed on the platform, or the carriage, or the slide, respectively.

In order for the processing unit to be manually moved, at least one handle which is connected to the platform or to the sewing machines is provided. One or a plurality of sensors by way of which a force exerted on the processing unit by the operator may be detected is/are disposed in the handle or respectively in the force transmission path between the handle and the sewing machine.

The sensor or sensors is/are preferably disposed in the region of the force introduction point into the platform or into the sewing machine, respectively. In the case of a plurality of handles being connected to the platform or to the sewing machine, respectively, at various points, one or a plurality of sensors is/are disposed on each of these force introduction points. The total force exerted on the processing unit by the operator is the result of the superimposition of the forces at the individual force introduction points.

By use of the items of information pertaining to the value and the effective direction of this force, a detection device calculates the respective proportions of force or the components of guiding force by way of which the operator acts on the processing unit for at least one, preferably for both movement directions. The geometric position or the alignment of the one sensor or of the sensors in relation to the movement directions of the processing unit may be fixedly predefined or may be variable, depending on the embodiment of the quilting device. The former may be variable in particular when the sensors are disposed on handles for which the position or alignment on the processing unit, respectively, is variable and adaptable to individual operator requirements. In the case of such quilting devices the detection device is configured to detect items of information pertaining to the position and the alignment of the sensors, respectively. This may be undertaken in an initialization process, for example, in which the operator exerts a force on the processing unit in only one of the two movement directions. The detection device from the measured values of two force sensors may calculate and memorize items of information pertaining to the geometric arrangement or alignment, respectively, of these sensors. By use of these memorized items of information and of the current measured values of the sensors during operation of the quilting device, the detection device calculates the forces which are exerted on the processing unit by the operator in both movement directions.

Determining the force exerted on the processing device by an operator is preferably performed directly by suitable force sensors, such as are known from the prior art. In order for a force acting in a predefined direction to be detected, dissimilar physical measuring principles may be utilized in the case of these sensors. For example, inductive, capacitive, resistive, or piezoelectric force sensors are known. It is essential for each force sensor to be configured and disposed in the force transmission path such that the measured value of said sensor unequivocally corresponds to the force which is exerted on the processing unit by the operator in a specific direction.

Alternatively, the force which is exerted on the processing device by an operator may also be derived indirectly from other measured values, should there be an unequivocal correlation between these measured values and this force. In this way, for example, the acceleration of the processing unit in the two movement directions may be detected by an acceleration sensor. For each of the movement directions, the product resulting from the acceleration in the respective direction and from the inert mass of the processing unit equals the total force of all superimposed part-forces which act on the processing unit in the respective movement direction. Part-forces for each of the movement directions substantially include the drive and deceleration force of the respective auxiliary motor, the force introduced by the operator in the respective movement direction, and resistance or friction, respectively. Should the other part-forces be known, the detection device by use of the measured acceleration of the processing unit in the respective direction may thus calculate for each of the movement directions the force which has been introduced by the operator in this direction. To this end, the drive force and the friction force (in each case for each of the movement directions) are subtracted from the product of inert mass and acceleration. The drive force of the auxiliary motor may by way of example likewise be detected by sensor technology, or from the torque of the auxiliary motor, or from the control current of the latter, respectively. The friction force of the quilting device per se may be considered to be the product of a coefficient of friction and of the normal force of the mass to be moved. Additional friction forces which are caused by the two-dimensional structure to be processed, for example, may be considered by way of a correction factor for the coefficient of friction.

Each of the auxiliary motors is controlled or regulated, respectively, by a controller device so as to depend on the guiding force of the operator in the respective movement direction that has been determined by the detection device. For this purpose, a transmission function which assigns actuation values for the respective auxiliary motor in an unequivocal manner to the values for the guiding force may be memorized in a memory of the controller device, for example. This transmission function may in particular be conceived such that the motorized drive force for the processing unit that is effected by the auxiliary motor may be proportional to the respective manual drive force. In other words, the force applied by the operator is linearly amplified by the respective auxiliary motor. The respective amplification factor may preferably be set by way of a suitable input device of the controller device, using an analog or digital setting device.

In the case of a refinement of this device, actuating each auxiliary motor may additionally be performed so as to depend on further parameters. The supportive effect of the auxiliary motor may in particular by reduced, as the relative speed of the processing device to the frame of the quilting device increases, for example.

Alternatively or additionally, the amplification factor may be predefined or adapted, respectively, so as to depend on the position of the processing device relative to the frame. In this way, a peripheral zone in which the amplification factor or the supportive effect of the auxiliary motor, respectively, decreases toward the periphery according to a predefined function, or is zero, may be defined in the utilizable range or at the region in which the processing unit may be moved on the frame, respectively. The width of this peripheral zone may optionally be adapted so as to depend on the respective speed of the processing unit. The higher this speed, the wider the width of the peripheral zone becomes. The purpose of the peripheral zone is to reduce the speed of the processing unit when the latter moves toward the periphery of the utilizable range. It may optionally also be provided that the amplification factor is negative at least in the outermost region of the peripheral zone when the speed of the processing installation in the direction toward the periphery is high and there is the risk of the processing installation potentially impacting on the delimiting frame.

Actuating each of the auxiliary motors by the controller device so as to depend on the guiding force exerted by the operator in the respective movement direction may also be performed in a different manner. In particular, the torque or the motor power, respectively, which is exerted by this auxiliary motor on the processing unit in the respective movement direction, or the power supply to the auxiliary motor may be regulated, wherein the guiding variable is predefined so as to depend on the guiding force and optionally so as to depend on further parameters. Regulating may be performed such, for example, that the torque of the auxiliary motor is at least approximately proportional to the associated component of the guiding force. Alternatively, the torque of the auxiliary motor could also be regulated such that the supportive effect of the auxiliary motor kicks in as soon as the guiding force reaches a predefinable value, limiting the guiding force to be applied by the operator to this value.

Of course, the detection device may be configured as a part of the controller device. The controller device preferably comprises controller elements and/or input elements by way of which an operating mode may be selected, functions may be controlled, and/or parameters such as a coefficient of friction, an amplification factor, or a width of the peripheral zone may be set, for example.

BRIEF DESCRIPTION OF THE DRAWINGS

The invention will be described in more detail with reference to a few figures in which.

DETAILED DESCRIPTION OF THE PREFERRED EMBODIMENTS

Figure 1:
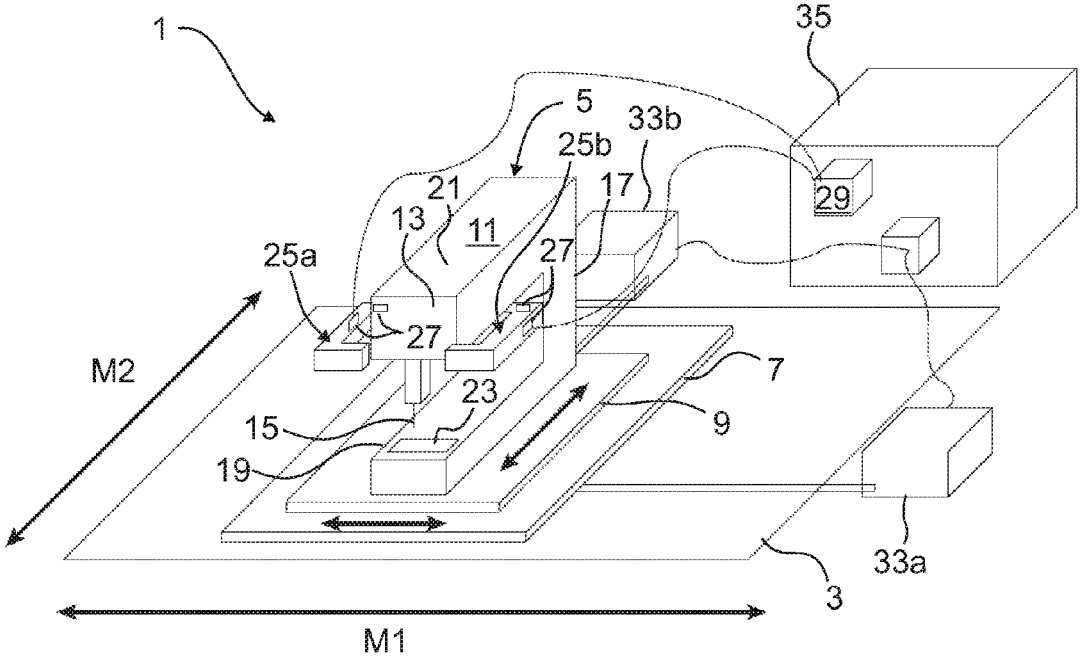
FIG. 1 shows a schematically illustrated part of a quilting device.

FIG. 1 in a schematic illustration shows part of a quilting device 1 having a quilting frame, referred to as frame 3 for short, on which a processing device 5 is mounted so as to be traversable in a first movement direction M1 and in a second movement direction M2 which is orthogonal thereto. The first movement direction M1 corresponds to the longitudinal direction of the frame 3, the second movement direction M2 corresponds to the shorter width direction of the frame 3. The frame 3, as are conventional quilting frames, is configured for holding a portion of a two-dimensional textile structure tensioned in such a manner that this portion is disposed in one processing plane, so as to be at least approximately parallel with the two movement directions M1 and M2. The two-dimensional structure may comprise one or a plurality of layers. The latter are typically rewindable from supply rolls, which are disposed at the front on the frame 3 so as to be parallel with the longitudinal direction thereof, to a common take-up roll, this take-up roll being likewise disposed above the processing plane so as to be parallel with the longitudinal direction of the frame 3 (not illustrated). The processing device 5 comprises a first carriage 7, or a slide, respectively, which guided on longitudinal guides (not illustrated) of the frame 3 is movable in the first movement direction Ml. The length of the longitudinal guides of the frame 3, and the mounting elements (not illustrated) of the first carriage 7 delimit the maximum possible freedom of movement of the first carriage 7 in the first movement direction M1. Moreover, the processing device 5 comprises a second carriage 9 which is guided on transverse guide (not illustrated) which are disposed on the first carriage 7 in a manner orthogonal to the longitudinal guides of the frame 3 so as to be movable in the second movement direction M2. The length of the transverse guides on the first carriage 7, and the mounting elements (not illustrated) of the second carriage 9 delimit the maximum possible freedom of movement of the second carriage 9 in the second movement direction M2.

A sewing machine 11, in particular a long-arm sewing machine, of which the stitch-forming tools 15 on the machine head 13 have a large spacing from the support 17 of preferably more than 30 cm, is fixedly or rigidly connected to the second carriage 9, respectively. The C-shaped support structure of the support 17, the lower arm 19, and the upper arm 21, in the case of such long-arm sewing machines is highly rigid.

The sewing machine 11 is aligned such that the lower arm 19 thereof and the upper arm 21 thereof are disposed so as to be parallel with the width direction of the frame 3, or with the second movement direction M2, respectively. The machine head 13 and the needle plate 23 disposed therebelow on the lower arm 19 face the front longitudinal guide of the frame 3, or the operator side of the quilting device 1 lying at the front, respectively. The position of the needle plate 23 defines the processing plane in which that portion of the two-dimensional textile structure that is to be processed is held under tension.

In an analogous manner, the processing device 5, as an alternative to a sewing machine 11, could also comprise another machine for processing the two-dimensional structure, for example a device for punching or cutting, or for drawing using a textile marker, or for applying decorative elements, such as sequins or rhinestones.

In order for the processing device 5 to be manually moved in a guided manner by an operator in the two movement directions M1 and M2, the processing device 5 comprises at least one handle 25*a*, 25*b*. In the case of the embodiment of the quilting device 1 schematically illustrated in FIG. 1, two handles 25*a*, 25*b* behind the machine head 13 are connected to the upper arm 21 of the sewing machine 11. Operating elements (not illustrated) for controlling functions of the quilting device 1 may optionally be disposed on these handles 25*a*, 25*b*. Preferably, each of the handles 25*a*, 25*b* comprises one or a plurality of elements or portions, respectively, of which the relative position and/or alignment to the sewing machine 11 is adjustable or settable, respectively, such that the handle 25*a*, 25*b* is adaptable to individual requirements of the respective operator. Because of the high rigidity of the sewing machine 11 and of the second carriage 9, each of the handles 25*a*, 25*b* by way of which an operator may exert a force directly on the processing unit 5, so as to move the latter in at least one of the movement directions M1 or M2, respectively, may be disposed on any suitable points of the processing device 5. In particular, the fitting point or the force transmission point of the handle 25*a*, 25*b*, respectively, may be disposed on the sewing machine 11 or on the second carriage 9. Alternatively, the handle 25*a*, 25*b* at a plurality of force transmission points (not illustrated) may be connected to the sewing machine 11 and/or to the second carriage. 9. One or a plurality of sensors 27 of a detection device 29 are disposed in the handle 25*a*, 25*b*, or in each of the force transmission paths from the handle 25*a*, 25*b*, respectively, to the sewing machine 11, or to the second carriage 9, respectively, such that the detection device 29 from the measured values of these sensors 27 may determine a manual guiding force which is exerted by the operator on the processing unit 5 in at least one, preferably in both movement directions M1, M2. This manual guiding force results from superimposing all proportions of guiding forces which the operator by way of all force transmission paths exerts on the processing unit 5 in the respective movement direction M1, M2. Here, forces with an opposing effective direction have dissimilar mathematical signs.

In the case of the assembly illustrated in FIG. 1, two handles 25*a*, 25*b* are fastened in a fixedly predefined position to the sewing machine 11, each of the handles 25*a*, 25*b* comprising one first force transmission leg which is aligned in a manner orthogonal to the first movement direction M1 and on which a strain gauge acting as the sensor 27 is disposed such that the measured value thereof corresponds to the respective proportion of guiding force in the first movement direction M1.

In an analogous manner, each of the handles 25*a*, 25*b* may comprise one second force transmission leg which is aligned in a manner orthogonal to the second movement direction M2 and has a sensor 27 which is disposed such that the measured value thereof corresponds to the respective proportion of guiding force in the second movement direction M2.

Figure 2:
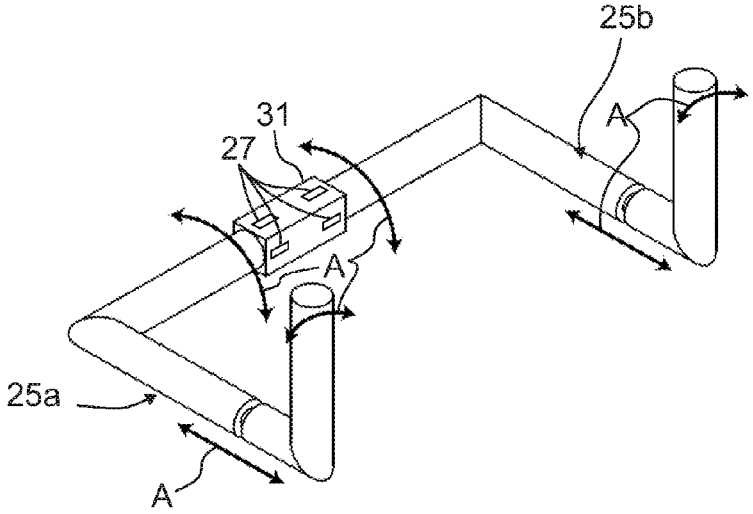
FIG. 2 shows an assembly of two adjustable handles.

As is illustrated by double arrows A in FIG. 2, the handles 25*a*, 25*b* may comprise one or a plurality of movable, in particular rotatable and/or length-adjustable portions. Preferably, the sensors 27 which are configured for detecting the guiding force components in the two movement directions M1, M2 are disposed on a coupling element 31 which is fixedly connected to the sewing machine 11 or to the second carriage 9, respectively. In this way, the sensors 27 may detect the guiding force components which are transmitted by way of the handles 25*a*, 25*b* and act in the two movement directions M1, M2, so as to be independent of the configuration of the handles 25*a*, 25*b*.

Should one or a plurality of sensors 27 be disposed in the force transmission path such that the position thereof, that is the position and/or alignment thereof in relation to the sewing machine 11 or to the second carriage 9, respectively, is variable so as to depend on the arrangement of the handles 25*a*, 25*b*, the detection device 29 when processing the measured values of these sensors 27 may consider additional items of information, in particular pertaining to the position of the sensors 27, so as to determine from the measured values of the sensors 27 proportions of the guiding force in the two movement directions M1 and M2. For this purpose, the detection device 29 may comprise elements or means for predefining or detecting the position of sensors. In particular, this may comprise further sensors which determine the position of those sensors 27 which detect the forces exerted on the processing device 5. Alternatively, this may comprise operating elements (not illustrated) for predefining the respective alignment or position of the sensors 27, respectively.

In the case of further alternative embodiments, the detection device 29 may comprise controlling rules which in an initialization process allow items of information pertaining to the relative alignment of the sensors 27 to the movement directions M1 and M2 to be obtained and to be memorized. In particular, the operator here by way of the screen of a user interface (not illustrated) may be requested to move or to accelerate, respectively, the processing unit 5 in the first movement direction M1. The associated proportions of force in these two directions are determined and memorized at two sensors 27 which are configured for detecting forces in two orthogonal directions. In a manner analogous thereto, the associated proportions of force may also be determined and memorized upon movement or acceleration, respectively, in the second movement direction M2. The detection device 29 by use of these values calculates the position or orientation, respectively, of the sensors 27 in relation to the movement directions M1 and M2. This essentially corresponds to a transformation of coordinates between the coordinate system of the force sensors 27 and that of the movement directions M1 and M2.

In order for a guiding force which is exerted by the operator on the processing device 5 to be detected directly, instead of or in addition to resistive force sensors such as strain gauges, force sensors which operate according to other physical measuring principles may also be used. Examples thereof are, in particular, piezoelectric, inductive, capacitive, or optical sensors 27.

Alternatively, the guiding force exerted on the processing device 5 by the operator may also be indirectly determined in that the acceleration of the processing device 5, or of the components thereof, respectively, in both movement directions M1 and M2 are detected by means of an acceleration sensor. This acceleration, when multiplied with the inert mass of the processing device 5, results in the total force which acts on the processing device 5. All known forces which act on the processing device 5 in addition to the guiding force of the operator are subtracted therefrom. The prerequisite is that the further forces which act on the processing device 5 are known.

In order for the movement or the drive, respectively, of the processing unit 5 to be supported, the quilting device 1 for at least one, preferably for both movement directions M1, M2 comprises one auxiliary motor 33*a*, 33*b* each. The first auxiliary motor 33*a* is operatively connected to the first carriage 7, the second auxiliary motor 33*b* being operatively connected to the second carriage 9. The transmission of force from the auxiliary motors 33*a*, 33*b* to the carriages 7, 9, respectively, may be performed in a known manner, for example by belts. Preferably, the first auxiliary motor 33*a* is disposed in a locationally fixed manner on the frame 33, the second auxiliary motor 33*b* being disposed in a locationally fixed manner on the first carriage 9.

Each of these auxiliary motors 33*a*, 33*b* is controlled or regulated by a controller device 35, so as to depend on the associated guiding force detected by the sensors 27 or determined by the detection device 29, respectively. The detection device 29 which processes the measured values of the sensors 27 is preferably configured as a part of the controller device 35.

Controlling or regulating, respectively, the auxiliary forces which are exerted by the auxiliary motors 33*a*, 33*b* on the associated carriages 7, 9 is performed by processing rules which are memorized in a program memory of the controller device 35. Preferably, further parameters such as, for example, the position of the processing device 5 and/or the speed thereof in relation to the frame 3, are detected and utilized for improved control in addition to the detected guiding forces in the two movement directions M1, M2. In particular, the controller device 35 may be configured via measured values or actuation values of the auxiliary motors 33*a*, 33*b* such as, for example, the actuation current thereof, to determine the torques or the forces thereof which are exerted on the processing device 5, respectively. A coefficient of dynamic friction may also be memorized in a memory of the controller device 35, for example. This enables the controller device 35 to calculate forces which act on the processing device 5 in addition to the force of an operator.

Preferably, the controller device 5 is configured to monitor the position of the processing device 5 within a utilizable range. This may be performed, for example, by evaluating the signals from incremental rotary encoders or from absolute rotary encoders on the auxiliary motors 33*a*, 33*b*. As soon as the processing device 5 is located within a predefined or a predefinable minimum spacing from the periphery of the utilizable range, the supportive force of the respective auxiliary motor 33*a*, 33*b* is at least interrupted or modified so as to be a deceleration force acting in the opposite direction.

LIST OF REFERENCE SIGNS

1 Quilting device
3 Frame
5 Processing device
7 First carriage
9 Second carriage
11 Sewing machine
13 Machine head
15 Tool
17 Support
19 Lower arm
21 Upper arm
23 Needle plate
25*a*, 25*b* Handles
27 Sensors
29 Detection device
31 Coupling element
33*a* First auxiliary motor
33*b* Second auxiliary motor
35 Controlling device

The invention claimed is:

1. A quilting device (1) comprising a processing unit (5) including a machine (11) for processing a two-dimensional structure, the machine being selected from a sewing machine, a device for punching or cutting, a device for drawing, or a device for applying decorative elements, a frame (3) on which the processing unit (5) is mounted for movement such that the processing unit is moveable by influence of a force adapted to be provided by an operator within a utilizable range of a guide plane in a first movement direction (M1) and in a second movement direction (M2), so as to process the two-dimensional structure at two dissimilar positions, a first auxiliary motor (33*a*) operatively connected to the processing unit (5), the first auxiliary motor is arranged to exert a first auxiliary force in the first movement direction (M1) on the processing unit (5), a detection device (29) including at least one sensor configured to detect a first guiding force which is exerted in the first movement direction (M1) on the processing unit (5) by the operator, and a controller (35) that receives a first input with respect to the first guiding force from the at least one sensor and controls the first auxiliary motor (33*a*) dependent upon the first guiding force detected by the at least one sensor.

2. The quilting device (1) according to claim 1, further comprising:

a second auxiliary motor (33*b*) operatively connected to the processing unit (5), the second auxiliary motor is arranged to exert a second auxiliary force in the second movement direction (M2) on the processing unit (5), wherein the at least one sensor of the detection device (29) is configured to detect a second guiding force which is exerted in the second movement direction (M2) on the processing unit (5) by the operator, and the controller (35) receives a second input with respect to the second guiding force from the at least one sensor and controls the second auxiliary motor (33*b*) dependent upon the second guiding force detected by the detection device.

3. The quilting device (1) according to claim 2, wherein the processing unit (5) further comprises a first carriage (7), a second carriage (9), and the sewing machine (11) is provided, the first carriage (7), guided on longitudinal guides of the frame (3), is mounted for movement in the first movement direction (M1) and is drivable by the first auxiliary motor (33*a*), and the second carriage (9), guided on transverse guides of the first carriage (7) that are aligned so as to be orthogonal to the longitudinal guides, is mounted for movement in the second movement direction (M2) and is drivable by the second auxiliary motor (33*b*), and the sewing machine (11) is rigidly connected to the second carriage (9) such that an upper arm and a lower arm (19) of the sewing machine (11) are aligned parallel with the transverse guides.

4. The quilting device (1) according to claim 3, wherein the processing unit (5) comprises at least one handle (25*a*, 25*b*)by which the processing unit is movable by at least one of the first or second guiding forces applied in at least one of the first movement direction (M1) or the second movement direction (M2), said handle (25*a*, 25*b*) is rigidly connected to the sewing machine (11) or to the second carriage (9) at a force transmission point, and the at least one sensor comprises a force sensor (27) provided in a force transmission path from the at least one handle (25*a*, 25*b*) to the force transmission point, the force sensor (27) detects a force which by way of the handle (25*a*, 25) is exerted on the processing unit (5) in a specific direction.

5. The quilting device (1) according to claim 4, wherein at least one of a position or an alignment of the force sensor is variable, and the detection device (29) detects a position of the force sensor (27).

6. The quilting device (1) according to claim 5, wherein the at least one handle comprises two of the handles and each of the handles has an associated one of the force transmission points, and further comprising an additional force sensor such that there are two of the force sensors (27) that are provided in the force transmission path of each of the handles (25*a*, 25*b*) to each of the associated force transmission points, and the force sensors detect the force components which are exerted by way of the respective handles (25*a*, 25) on the processing unit (5) in two dissimilar directions.

7. The quilting device (1) according to claim 4, wherein the force transmission point comprises a coupling element (31) which is fixedly connected to the sewing machine (11) or to the second carriage (9), respectively, and two of the force sensors (27) are disposed on said coupling element (31) such that the force sensors are adapted to detect components of the first and second guiding forces in the first movement direction (M1) and in the second movement direction (M2) independent of a configuration of the handle.

8. The quilting device (1) according to claim 7, wherein the controller device (35) comprises a setting element configured to at least one of set or modify an amplification factor, a transmission function, or both the amplification factor and the transmission function which predefines the force provided by the respective auxiliary motor (33*a*, 33*b*), so as to depend on the associated guiding force component.

9. A method for moving a processing unit (5) in a quilting device (1), the method comprising:

providing a quilting device (1) including a processing unit (5) with a sewing machine, a frame (3) on which the processing unit (5) is mounted for movement such that the processing unit is moveable by influence of a force adapted to be provided by an operator within a utilizable range of a guide plane in a first movement direction (M1) and in a second movement direction (M2), so as to process a two-dimensional structure at two dissimilar positions, a first auxiliary motor (33*a*) operatively connected to the processing unit (5), the first auxiliary motor being arranged to exert a first auxiliary force in the first movement direction (M1) on the processing unit (5), a detection device (29) including at least one sensor configured to detect a first guiding force which is exerted in the first movement direction (M1) on the processing unit (5) by the operator, and a controller (35) that receives a first input with respect to the first guiding force from the at least one sensor and controls the first auxiliary motor (33*a*) based on the first guiding force detected by the at least one sensor, a second auxiliary motor (33*b*) operatively connected to the processing unit (5), the second auxiliary motor is arranged to exert a second auxiliary force in the second movement direction (M2) on the processing unit (5), the at least one sensor of the detection device (29) is configured to detect a second guiding force which is exerted in the second movement direction (M2) on the processing unit (5) by the operator, and the controller (35) receives a second input with respect to the second guiding force from the at least one sensor and controls the second auxiliary motor (33*b*) dependent upon the second guiding force detected by the detection device, the processing unit (5) further comprises a first carriage (7), a second carriage (9), the first carriage (7), guided on longitudinal guides of the frame (3), is mounted for movement in the first movement direction (M1) and is drivable by the first auxiliary motor (33*a*), and the second carriage (9), guided on transverse guides of the first carriage (7) that are aligned so as to be orthogonal to the longitudinal guides, is mounted for movement in the second movement direction (M2) and is drivable by the second auxiliary motor (33*b*), and the sewing machine (11) is rigidly connected to the second carriage (9) such that an upper arm and a lower arm (19) of the sewing machine (11) are aligned parallel with the transverse guides, the processing unit (5) further including at least one handle (25*a*, 25*b*) by which the processing unit is movable by at least one of the first or second guiding forces applied in at least one of the first movement direction (M1) or the second movement direction (M2), said handle (25*a*, 25*b*) is rigidly connected to the sewing machine (11) or to the second carriage (9) at a force transmission point, and the at least one sensor comprises a force sensor (27) provided in a force transmission path from the at least one handle (25*a*, 25*b*) to the force transmission point, the force sensor (27) detects a force which by way of the handle (25*a*, 25) is exerted on the processing unit (5) in a specific direction , the force transmission point comprises a coupling element (31) which is fixedly connected to the sewing machine (11) or to the second carriage (9), respectively, and two of the force sensors (27) are disposed on said coupling element (31) such that the force sensors are adapted to detect components of the first and second guiding forces in the first movement direction (M1) and in the second movement direction (M2) independent of a configuration of the handle;

the detection device (29) detecting the guiding force component which is exerted on the processing unit (5) in at least one of the two movement directions (M1, M2) by an operator; and the controller device (35) controlling the respective auxiliary motor (33*a*, 33*b*) dependent on said guiding force component such that the force of the auxiliary motor (33*a*, 33*b*) supports the guiding force for moving the processing unit (5) within the utilizable range.

* * * * *